US006942522B2

(12) United States Patent
Nishimura

(10) Patent No.: US 6,942,522 B2
(45) Date of Patent: Sep. 13, 2005

(54) TERMINATION DEVICE

(75) Inventor: Hiroaki Nishimura, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/895,942

(22) Filed: Jul. 22, 2004

(65) Prior Publication Data

US 2005/0026504 A1 Feb. 3, 2005

(30) Foreign Application Priority Data

Jul. 31, 2003 (JP) ..... 2003-204458

(51) Int. Cl.[7] ..... H01R 13/66
(52) U.S. Cl. ..... 439/620; 333/22 R; 338/216
(58) Field of Search ..... 439/620, 578–585, 439/92, 101, 108; 333/22 R, 81 A, 220; 338/216

(56) References Cited

U.S. PATENT DOCUMENTS

| | | | | |
|---|---|---|---|---|
| 3,324,424 A | | 6/1967 | Barker | |
| 3,384,819 A | | 5/1968 | Rinkel | |
| 4,660,921 A | * | 4/1987 | Hauver | 439/578 |
| 4,838,813 A | * | 6/1989 | Pauza et al. | 439/620 |
| 5,047,737 A | | 9/1991 | Oldfield | |
| 5,598,132 A | * | 1/1997 | Stabile | 333/22 R |
| 5,904,596 A | * | 5/1999 | Knaus et al. | 439/620 |
| 6,712,647 B2 | * | 3/2004 | Khemakhem et al. | 439/620 |

FOREIGN PATENT DOCUMENTS

| | | |
|---|---|---|
| JP | 57-53001 | 11/1982 |
| JP | 04372204 | 12/1992 |

* cited by examiner

*Primary Examiner*—Gary Paumen
(74) *Attorney, Agent, or Firm*—Takeuchi & Kubotera, LLP

(57) ABSTRACT

The termination device to connect with the other piece of a coaxial connector in the coaxial connector, which comprises a first component comprised of a terminal to electrically connect with the center conductor of the other piece of the coaxial connector and an outer conductive piece to electrically connect with the outer conductor of the other piece of the coaxial connector, and a second component comprised of a ground conductive piece to electrically connect with the outer conductor of the first component, a relay section to elastically connect with the terminal of the first component at least in the axial direction, and a resistive element that is electrically connected with the ground conductive piece and the relay section and electrically connects between the ground connector and the center conductor of the other piece of the coaxial connector.

8 Claims, 4 Drawing Sheets

TERMINATION DEVICE

BACKGROUND OF THE INVENTION

1. Field of the Invention

The present invention relates to a termination (device), especially the one intended for high frequency applications.

2. Description of the Related Art

For example, U.S. Pat. No. 5,047,737 discloses an example of a conventional termination. FIG. 4 is a perspective view of the conventional termination, and FIG. 5 shows the cross-sectional view taken along the line 5—5 of FIG. 4. This termination 80 is comprised of a conductive piece 81 to electrically connect with the center conductor 81 of the other piece of the coaxial connector, a ground conductive piece 82 to electrically connect with an outer conductor of the other piece of the coaxial connector, and a resistive element 83 that is electrically connected between the conductor 81 and the ground conductive piece 82.

As described in the U.S. Pat. No. '737, in order to ground the coaxial impedance of the conductor 81 with the termination, the shape of the ground conductive piece needs to be carefully controlled. More specifically, the variance of the distance 85 in a cavity 84 between the resistive element 83 and the ground conductive piece 82 is important. In this case, in order to achieve generally constant resistance in any portion of the resistive element 83, the distance 85 between the resistive element 83 and the ground conductive piece 82 in the direction vertical to the axial direction of the resistive element 83 needs to be varied so as to form a suspended substrate line. However, it is difficult to form a smooth line.

As fully illustrated in FIG. 5, in the U.S. Patent, in order to solve the problem, in the cavity 84 between the resistive element 83 and the ground conductive piece, the ground conductive piece has a step-like surface and the surface is tapered down to the connecting section between the resistive element 83 and the ground conductive piece 82. However, with such step-like variance of the distance, it is impossible to provide a termination having stable performances especially for high frequency applications.

In addition, coaxial impedance that can be used (grounded) with a termination is usually determined by the ratio of outer diameter of a connecting section between the resistive element 83 and the conductor 81 to the outer diameter of the cavity around the connecting section. Especially in a high frequency termination, the former outer diameter has to be extremely small. However, the size of this outer diameter is easily affected by the height of the solder (not illustrated) applied for anchoring the resistive element to the conductor 81. Since it has been difficult to control the amount of the solder in the conventional termination, it has been difficult to achieve constant precision of the termination.

Furthermore, for example, the stress generated during the connection between termination and the connector significantly affects a relatively weak portion such as a soldered portion between the resistive element 83 and the conductor 81, and this stress has mechanically and electrically substantial impact on the termination. Therefore, there has been a demand of means to efficiently eliminate such stress.

SUMMARY OF THE INVENTION

In view of the above problems in the conventional techniques, an objective of the present invention is to provide a termination having stable performances.

More specifically, the objective of this invention is to provide a high frequency termination having stable performances by making smooth variance in the distance in the cavity between the resistive element and the ground conductive piece in the direction vertical to the axial direction of the resistive element.

Another objective of this invention is to provide a high frequency termination having stable performances by controlling the amount of solder to apply for anchoring the resistive element to the conductor, and by controlling the outer diameter of the cavity around the connecting section between the resistive element and the conductor.

Still another objective of this invention is to provide a high frequency termination having stable performances, for example, by effectively eliminating the stress that can be generated in the soldered portion or other portion when the terminator is connected with the connector.

In order to achieve the above objectives, the termination (device) of the present invention, which is to be connected to the other piece of the coaxial connector in the axial direction, is comprised of a first component, which has a terminal piece to electrically connect with the center conductor of the other piece of the coaxial connector and the outer conductive piece to electrically connect with the outer conductor of the other piece of the coaxial connector, and a second component, which has a ground conductive piece to electrically connect with the outer conductive piece of the first component, a relay section to elastically connect with the terminal piece of the first component at least in the axial direction and the resistive element to electrically connect with the ground conductive piece and the relay section so as to electrically connect between the ground conductive piece and the center conductor of the other piece of the coaxial connector.

In the above termination, the relay section of the second component can have a slotted section, and the terminal piece of the first component can have a locking section to prevent the second component from coming off from the first section by the elastic deformation of the slotted section. With such constitution, the terminal piece of the first component and the relay section of the second component can be elastically connected by elastically deforming the slotted section through pushing it in the axial direction into the locking section, which prevents the second component from coming off from the first component.

Also, in the above termination, the relay section having the slotted section is tapered down to its end. The narrower portion of the slotted section can be provided only around the section inserted into the locking section.

Furthermore, in the above termination, the relay section of the second component can have a guiding section that extends from the relay section in the axial direction, and the terminal piece of the first component can have a guiding hole to guide the guiding section.

In the present invention, the termination has a first component comprised of a terminal piece to electrically connect with the center conductor of the other piece of the coaxial connector and the outer conductive piece to electrically connect with the outer conductor of the other piece of the coaxial connector, and a second component comprised of a ground conductive piece to electrically connect with the outer conductive piece of the first component, a relay section to connect with the terminal piece of the first component, and the planar resistive element that is connected with the ground conductive piece and the relay section and electrically connects between the ground conductive piece and the center conductor of the other piece of the coaxial connector. The ground conductive piece has a step-like tapered surface such that the distance in the cavity between the ground conductive piece and the resistive element in the direction vertical to the axial direction of the resistive element becomes smaller towards the connecting section between the ground conductive piece and the resistive element.

Furthermore, the termination of this invention has a first component comprised of a terminal piece to electrically connect with the center conductor of the other piece of the coaxial connector and the outer conductive piece to connect with the outer conductor of the other piece of the coaxial connector, and a second component comprised of the ground conductive section to electrically connect with the outer conductor of the other piece of the coaxial connector, the relay section to connect with the terminal piece of the first component, and the resistive element that is connected to the ground conductive piece and the relay section and electrically connects between the ground conductive piece and the center conductor of the other piece of the coaxial connector, and a means to control the amount of solder to apply on the connecting section between the resistive element and the relay section.

In the above termination, the means to control the amount of solder can be a tubular member that surrounds the connecting section.

In addition, the above termination can further comprises a housing component that houses the first component and the second component, and maintains the connection between the first and the second components.

DESCRIPTION OF THE PREFERRED EMBODIMENTS

1. Whole Constitution

Figure 1:
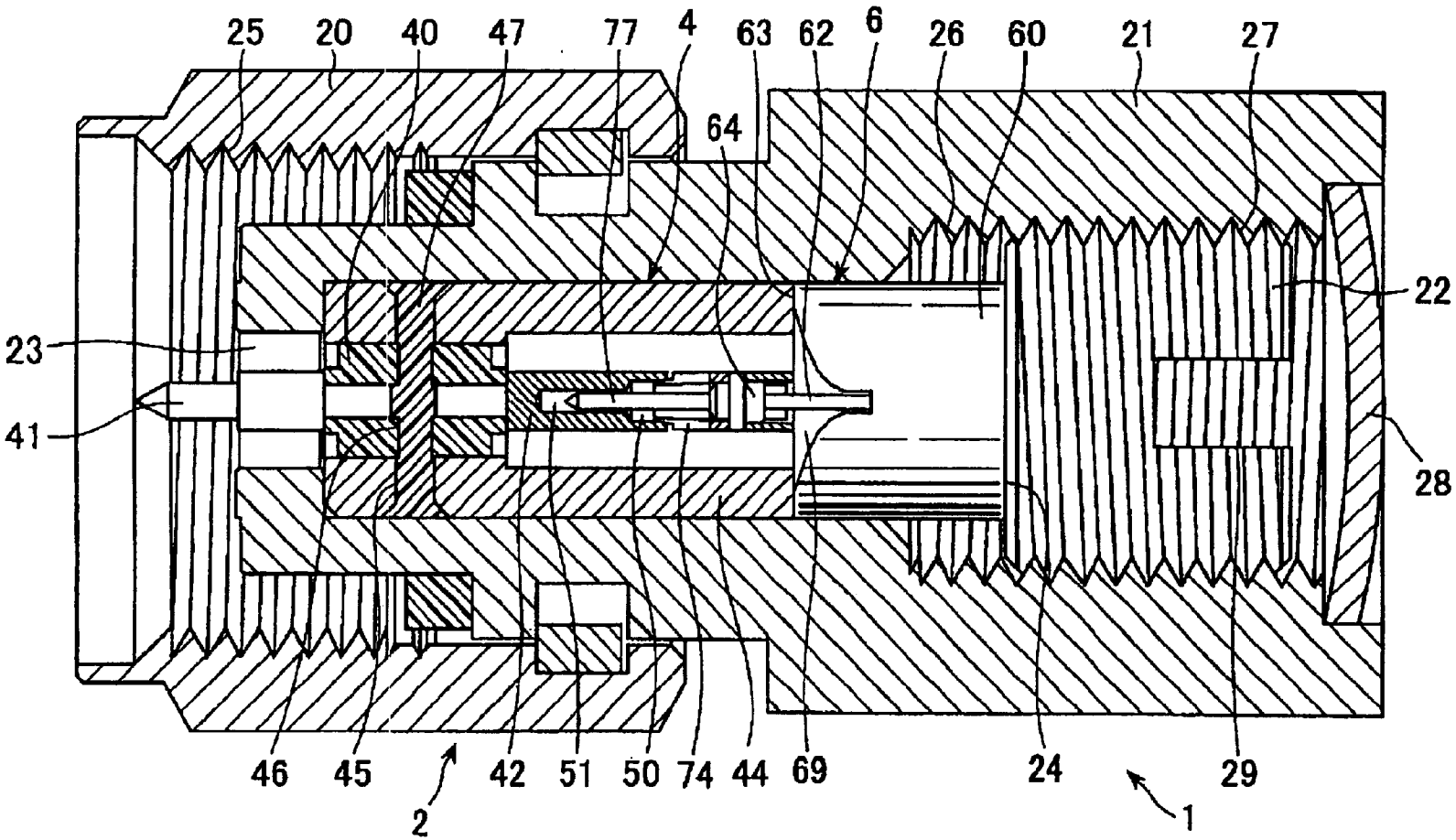
FIG. 1 is a cross-sectional view of the termination (device) of the invention, which is taken along the centerline.
Figure 2:
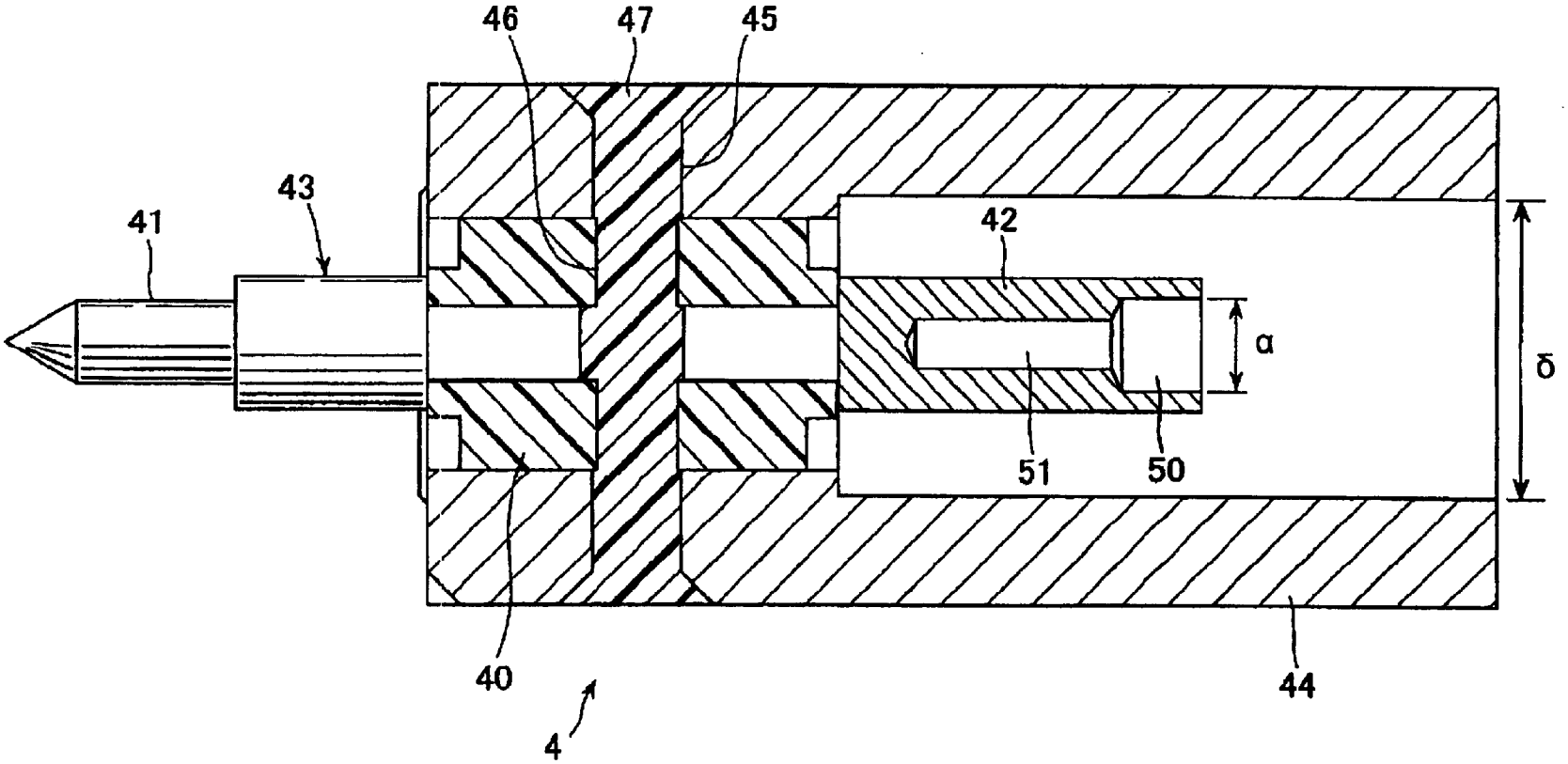
FIG. 2 is a cross-sectional view of the first component housed inside the termination, which is taken along the centerline.
Figure 3:
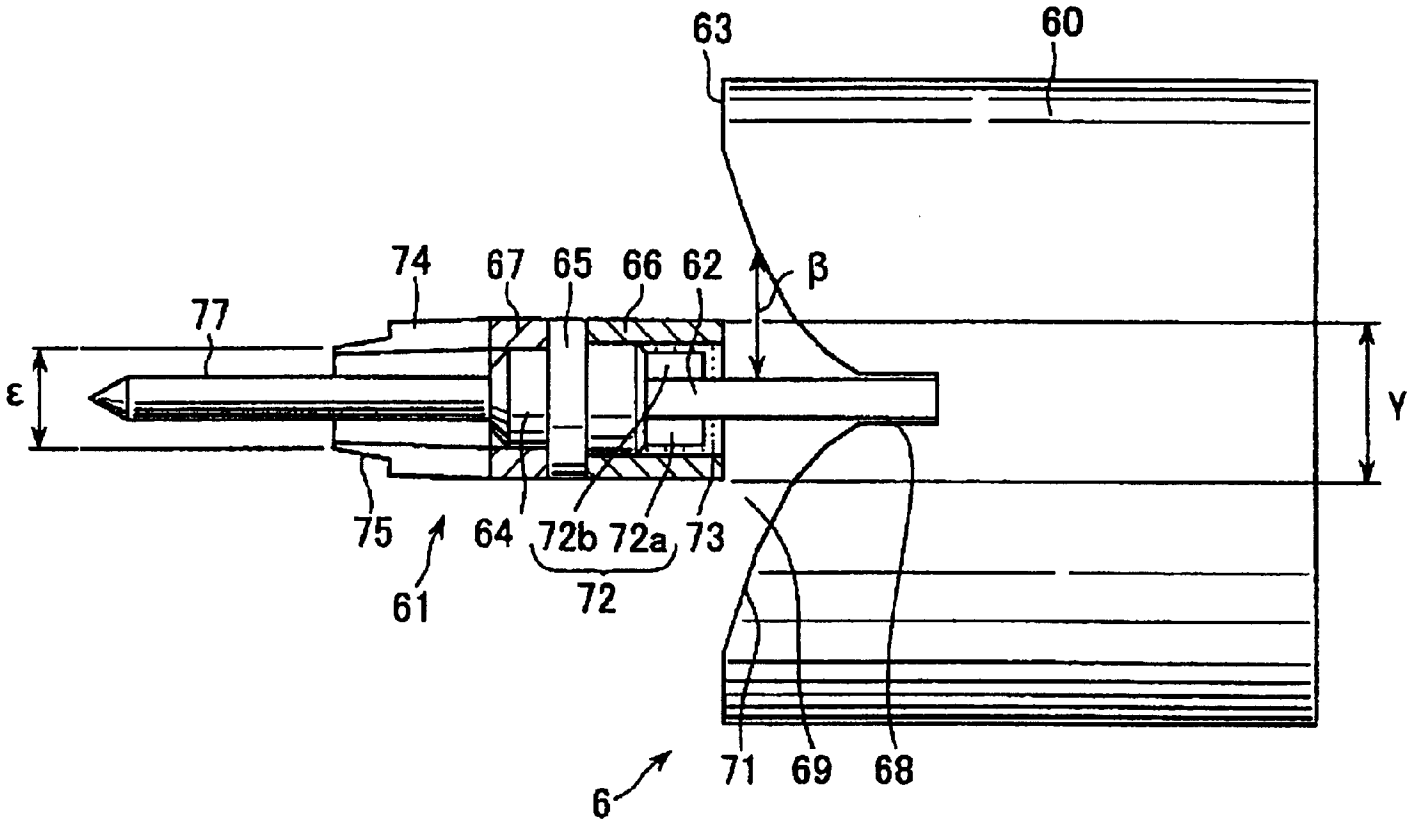
FIG. 3 is a cross-sectional view of the second component housed inside the termination, which is taken along the centerline.
Figure 4:
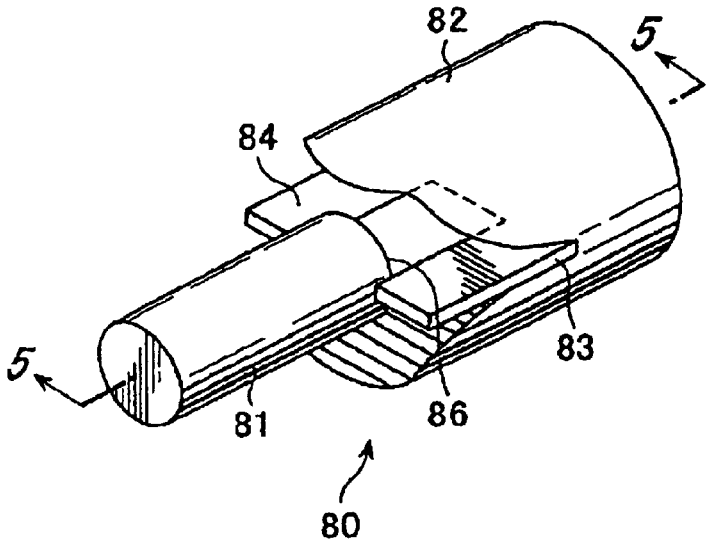
FIG. 4 PRIOR ART
FIG. 4 is a perspective view of the conventional termination.
Figure 5:
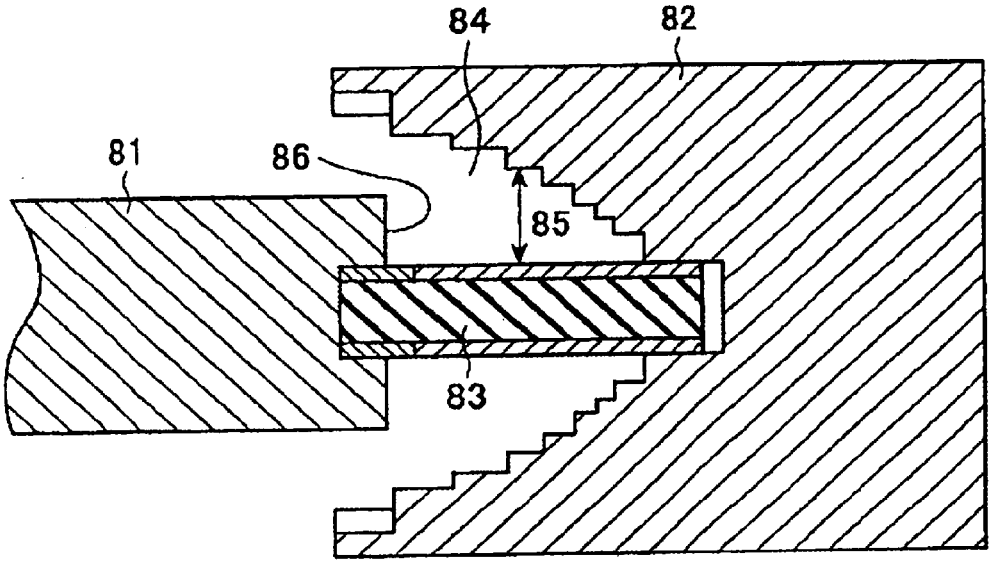
FIG. 5 PRIOR ART
FIG. 5 is a cross-sectional view of FIG. 5, which is taken along the line 5—5 of FIG. 4.

FIG. 1 shows a cross-sectional view taken along the centerline of the termination of this invention, and FIGS. 2 and 3 show cross-sectional views of the first and the second components to be housed in the termination, respectively.

The termination (device) 1 of this invention is comprised of a lockscrew 2, the first component 4 and the second component 6, which can be housed inside the lockscrew 2. Any of the lockscrew 2, the first component 4, and the second component 6 can be separated from each other. Unless it is stated, it is considered that all those components are made of a conductive material.

1-1. Lockscrew

Referring now to FIG. 1, the construction of the lockscrew will be described below. This lockscrew 2 forms the outermost part of the termination 1, and works as a housing component to hold and house the first component 4 and the second component 6.

The lockscrew 2 is comprised of three screw components that can be coaxially connected to each other. More specifically, it is comprised of a first screw component 20 to connect the termination 1 with the other piece of the coaxial connector, a second screw component to support the first screw component at its one end and mainly to house the first component 4 and the second component 6, and a third screw component that can be screwed into the second screw component at the other end, which is opposite side to the first screw component. The lockscrew 2 can further comprise a lid to cover the end surface of the third screw component 22, which is opposite side to the first screw component.

The first screw component 20 is bored so as to have a hallow structure having a specified diameter throughout its length around the center axis, whereby one end of the second screw component 21 can be housed therein.

The second screw component 21 is bored so as to have a hallow structure having a specified diameter throughout its length around the center axis, whereby a part of the first component 4 and the second component 6 can be housed therein. In addition, the second screw component 21 has a relatively small hole 23 on its end at the first screw component 20 side, so that the first component 4 and the second component housed in the second screw component 21 will not come off from the hole 23.

One end of the third screw component 22 is partially bored to a specified depth in order to house a part of the second component 6. A screwslot 29 can be provided on the other end of the third screw component so as to make screwing the third screw component 22 easy with a screwdriver.

The inside of the first screw component 20 is partially threaded on the opposite side of the second screw component 21. By connecting this threaded section 25 with a specified portion of the other piece of the coaxial connector, for example, with a threaded part (not illustrated) provided so as to surround the coaxial cable in the axial direction, the lockscrew 2 can be connected with the other piece of the coaxial connector via the first screw component 20. Here, in order to easily connect the first screw component 20 with the other piece of the coaxial connector, the first screw component 20 can be rotated around its center axis with respect to the second screw component 21 and the third screw component 21 even after assembling of the lockscrew 2.

On the other hand, the inner surface 26 of the second screw component 21 and the outer surface 27 of the third screw component 22 are also threaded for connecting between the second and the third screw components. Through those threaded sections 26 and 27, the second screw component 21 and the third screw component 22 are anchored to each other. After inserting the first component 4 and then the second component 6 into the second screw component 21 in a specified direction, and then closing the second screw component 21 with the third screw component 22, the first component 4 and the second component 6 are "substantially completely" housed and held in the lockscrew 2, and the distance between the first component 4 and the second component 6 can be maintained constant at least in the axial direction. Here, the terms "substantially completely" are used because a part (a first male terminal 41) of the first component 4 is still exposed to the outside of the lockscrew 2 even after the first component 4 and the second component 6 are completely housed and held in the lockscrew 2. This exposed first male terminal 41 is intended to connect with the connecting terminal of the other piece of the coaxial connector.

In the above-described Working Examples, the connection with the other piece of the coaxial connector is made through the threaded section of the first screw component 20, but it can be made through a "push-on lock" mechanism ("simple lock" mechanism). As easily understood, the connection with the other piece of the coaxial connector is not limited to those methods. In addition, the first screw component 20 can be provided on the other piece of the coaxial connector.

1-2. First Component

In next, referring to FIG. 2, the constitution of the first component will be described below. The first component 4 has a generally cylindrical shape corresponding to the shape of the inner surface of the second screw component 21, and is comprised of a terminal member 43 having a first male terminal 41 and a second male terminal 42 on the respective ends of the center conductor 40, and the outer conductor 44 that is supported and fixed to the terminal member 43, surrounding the outer surface of the terminal member 43.

The terminal member 43 and the outer conductor 44 can be anchored to each other with resin. After inserting the terminal member 43 into the outer conductor 44 and then adjusting the positions of matching holes 45, 46 by matching those holes, the terminal member 43 and the outer conductor 44 can be anchored to each other in a desired direction by pouring resin 47 into the matching holes 45 and 46. As shown in the figure, since the matching holes 45 and 46 are provided in a direction that crosses the axial direction, the anchored terminal member 43 and outer conductor 44 have strong resistance against a force in the axial direction.

When the termination 1 is used, the terminal member 43 is electrically connected with the center conductor (not illustrated) of the other piece of the coaxial connector and receives electric signals. On the other hand, the outer conductor 44 is connected with the outer conductor (not illustrated) of the other piece of the coaxial connector and receives electric signals.

The signals received by the first male terminal 41 are then transmitted to the second component 6 (see FIG. 3) via the center conductor 40 and the second male terminal 42. In order to connect between the second male terminal 42 and the second component, the second male terminal 42 has a hole 50 having a relative large diameter a on its one end, and also has a guiding hole 51 having a relative small diameter at the deepest position of the hole 50 so as to make the connection easy.

1-3. Second Component

In next, referring to FIG. 3, the constitution of the second component will be described below. The second component 6 is comprised of the ground conductive piece 60 having a generally cylindrical shape corresponding to the shape of the inner surface of the second screw component 21, the relay or joint section 61 used in the middle of the connection with the first component 4, and a chip-type planar resistive element 62 that is connected with both the ground conductive piece 60 and the relay section 61.

The relay section 61 is further comprised of the connecting terminal 64 to connect with the resistive element 62, a cylindrical union 66 and a relay tube 67 that are respectively provided at the ground conductive piece side and the first component side of the flange 65 of the connecting terminal 64. The resistive element 62 is connected with the ground conductive piece 60 at its one end, and with the relay section at the other end.

Through this connection, the ground conductive piece 60 can be electrically connected with the center conductor of the other piece of the coaxial connector. In addition, the ground conductive piece 60 is electrically connected (see FIG. 1) with the end surface of the outer conductor (see FIGS. 1 and 2) of the first component at its end section 63 that faces the cavity 69, and therefore the ground conductive piece can be also connected with the outer conductor of the other piece of the coaxial connector.

The features of this invention will be even more fully described below.

The resistive element 62 is anchored to the ground conductive piece by pressing it into a slot 68, which is provided in the deepest portion of the cavity 69 of the ground conductive piece 60 in the axial direction, or by connecting them with solder. As described above, the variance of the distance β in the cavity between the resistive element 62 and the ground conductive piece 60 in a direction vertical to the axial direction of the resistive element is critical. In the present invention, the ground conductive piece has a step-like tapered surface 71 such that the distance β becomes gradually and smoothly smaller towards the slot 68. Especially, in the high frequency termination 1, since the length of the resistive element in the axial direction is short, and the variance of the distance between the resistive element 62 and the ground conductive piece 60 tends to be larger than general termination 1, it is extremely effective to have such tapered step-like surface 71.

On the other hand, the resistive element 62 is pressed between slit members 72*a* and 72*b* that have semicircular cross-section and form a slit between them. By applying solder 73 around the slit 72, the resistive element 62 is anchored therein. Here, it is not fully illustrated in the figure, but the solder 73 is applied all around the slit 72 (since this figure is a cross-sectional view taken along the centerline, how solder is applied is not fully illustrated). As is well known, since the amplitude of the frequency usable in this termination is determined by the ratio of the size of the outer diameter γ of the connecting section between the resistive element 62 and the connecting terminal 64 to the outer diameter δ (see FIG. 2) of the cavity in the outer conductor 44, it is preferred to control the outer diameter γ around the slit to an ideal size. Especially in the termination for high frequency applications, e.g. 65 GHz, the outer diameter γ around the slit has to be extremely small, about 0.8 mm, depending on the cut-off frequency. For this reason, in this invention, the amount of solder is controlled by having a union 66 that substantially surrounds the slit 72 and then applying solder inside the union 66. According to this constitution, since the solder 73 will hardly leak from the outside of the union 66, ideal coaxial size can be easily achieved even at the soldered portion. Therefore, according to this invention, high frequency termination can be stably provided.

Further referring to FIGS. 1–3, how to solve the stress generated when the termination is connected with the connector will be described below. This stress is troublesome especially for the high frequency termination. To solve this problem, in this invention, the first component 4 and the second component 6 are elastically connected at least in the axial direction by a spring structure, using the relay tube 67 of the second component 6 and the second male terminal 42 of the first component 4. To achieve the spring structure, the relay tube 67 has a slotted section 74 that has a slot(s) along a direction parallel to the axial direction on the connecting side with the first component. In addition, at least the portion 75 near the end of the relay tube 67 having the slotted section 74 becomes narrower towards the end. The diameter ϵ of the end is designed to be slightly smaller than the diameter α (see FIG. 2) of the opening on the end of the second male terminal 42 of the first component 4. Here, as shown in the figure, the narrower end of the relay tube 67 is not provided all along the slotted section, but preferably provided only around a portion to be inserted into the second male terminal 42. According to this constitution, the relay tube 67 can be even more reinforced.

In such constitution, when the first component 4 and the second component 6 are moved close to each other in the axial direction, the guiding section 7 that extends in the axial direction from the center of end surface of the connecting terminal 64 of the second component 6 is first guided to the hole 50 provided on the end surface of the second male terminal 42 of the first component 4. When those components are moved even closer to each other, the guiding section 77 that extends in the axial direction from the center of the end surface of the connecting terminal 64 is guided into the guiding hole located in the deepest portion of the hole 50, and simultaneously the slotted section of the relay tube 67 is elastically deformed while the relay tube is pressed in the axial direction into the hole provided on the end surface of the second male terminal 42.

As is clear, according to this connecting method, for example, not only the stress in the axial direction, which can be generated when connected with the connector, but also the stress in the cross direction can be eliminated. Therefore, for example, the stress that can be generated in the soldered potion between the resistive element 62 and the connecting terminal 64, which is easily damaged, can be effectively eliminated. Furthermore, as described above, the distance between the relay tube 67 and the second male terminal 42 is controlled by the dimension of the housing portion of the fix screw 2. However, since the relay tube 67 is elastically connected with the second male terminal 42, dimensional precision is not seriously required even in the housing portion of the lockscrew 2. In addition, as generally understood, on the both ends of the termination, for example, on the respective ends of the first male terminal 41 and the ground conductive piece 60, the dimensional precision is seriously required for maintaining the performances. However, according to the present invention, the dimensional error can be adjusted by the elastic connection between the relay tube 67 and the second male terminal 42, even such serious precision required on the ends of the termination can be maintained.

1-4. Other Components

In the above embodiments, the relay tube 67 of the second component 6, which has a slotted section, is attached into the hole provided at the second male terminal of the first component 4. However, the relay tube 67 does not have to be attached into a hole, as long as it is attached to a mechanism that can prevent the second component from coming off from the first component by elastic deformation of the slotted section. For example, it can be a structure comprised of a simple upper plate and lower plate.

In addition, as a means to control the amount of solder, the tubular union 66 having a circular cross section is used in the above embodiments, but a tubular union having a rectangular cross section can be also used. In other words, it is satisfactory as long as the means for control the amount of solder is provided so as to surround generally whole soldered portion.

According to this invention, the termination having stable performances can be provided. Furthermore, by the tapered surface of the ground conductive piece, the distance between the ground conductive piece and the resistive element can be even more smoothly varied. In addition, by the means for controlling the amount of solder around the connecting section between the resistive element and the conductor, the amount of solder applied for the connection can be controlled. Moreover, by the relay section provided in the termination between the portion to be connected with the connector and the ground conductive piece, for example, the stress generated when the termination and the connector are connected can be effectively eliminated.

Here, the present invention can be applied to general terminations, and has great advantage especially when it is used for high frequency applications.

What is claimed is:

1. A termination device which is connected to a coaxial connector in the axial direction, comprising:

a first component comprised of:

a terminal piece to electrically connect with a center conductor of said coaxial connector; and an outer conductive piece to electrically connect with an outer conductor of said coaxial connector; and a second component comprised of:

a ground conductive piece to electrically connect with said outer conductive piece of said first component;

a relay piece to elastically connect with said terminal piece of said first component at least in the axial direction; and a resistive element that is electrically connected with said ground conductive piece and said relay piece, and electrically connects between said ground conductive piece and said center conductor of said coaxial connector.

2. The termination device of claim 1, wherein said relay piece of said second component has a slotted section, and said terminal piece of said first component has a locking section to prevent said second component from possibly coming off from the first component by elastic deformation of said slotted section, and said terminal piece of said first component and said relay piece of said second component are elastically connected by pressing said slotted section into said locking section in the axial direction so as to elastically deform said slotted section.

3. The termination device of claim 2, wherein said relay piece having said slotted section is tapered down to its end, and a narrower section of said relay piece is provided only around a portion to be inserted into said locking section.

4. The termination device according to claim 1, wherein said relay piece of said second component has a guiding section that extends in the axial direction from said relay piece, and said terminal piece of said first component has a guiding hole to guide said guiding section.

5. The termination according to claim 1, further comprising a housing component to house said first component and said second component, and to maintain a connection between said first and said second components.

6. A termination device, comprising:

a first component comprised of:

a terminal piece to electrically connect with a center conductor of a coaxial connector; and an outer conductive piece to electrically connect with an outer conductor of said coaxial connector; and a second component comprised of:

a ground conductive piece to electrically connect with said outer conductive piece of said first component;

a relay piece to connect with said terminal piece of said first component; and a planar resistive element that is connected with said ground conductive piece and said relay piece and electrically connects between said ground conductive piece and said center conductor of said coaxial connector, wherein said ground conductive piece has a step-like tapered surface, whereby the distance between said resistive element and said tapered surface in the direction vertical to the axial direction of said resistive element becomes smaller towards a connecting section between said ground conductive piece and said resistive element.

7. A termination, comprising:

a first component comprised of:

a terminal piece to electrically connect with a center conductor of a coaxial connector; and an outer conductive piece to electrically connect with an outer conductor of the coaxial connector;

a second component comprised of:

a ground conductive piece to electrically connect with said outer conductive piece of said first component;

a relay section to connect with said terminal piece of said first component; and a resistive element that is connected with said ground conductive piece and said relay section and electrically connects between said ground conductive piece and said center conductor of the coaxial connector; and a means for controlling the amount of solder to apply on a connecting section between said resistive element and said relay section.

8. The termination of claim 7, wherein said means for controlling the amount of solder is a tubular member that surrounds said connecting section.

* * * * *